US006700500B1

(12) United States Patent
Burnett

(10) Patent No.: US 6,700,500 B1
(45) **Date of Patent: *Mar. 2, 2004**

(54) APPLIANCE HAZARD WARNING DEVICE

(76) Inventor: S. Mark Burnett, 1545 Mound St., Sarasota, FL (US) 34236

( * ) Notice: Subject to any disclaimer, the term of this patent is extended or adjusted under 35 U.S.C. 154(b) by 0 days.

This patent is subject to a terminal disclaimer.

(21) Appl. No.: 10/140,030

(22) Filed: May 6, 2002

(51) Int. Cl.[7] ..... G08B 21/00

(52) U.S. Cl. ..... 340/686.6; 340/686.1; 340/689; 340/545.6; 134/113

(58) Field of Search ..... 340/686.6, 686.1, 340/689, 545.1, 545.5, 545.6, 546, 429, 908.1, 982, 983; 200/621.45 R, 621.52; 134/113

(56) References Cited

U.S. PATENT DOCUMENTS 4,059,832 A * 11/1977 Conklin ..... 340/546
4,808,974 A * 2/1989 Cantley ..... 340/546
4,894,643 A 1/1990 Thompson et al.
5,151,884 A 9/1992 Griffith et al.
5,341,123 A * 8/1994 Schuman, et al. ..... 340/546
5,479,152 A * 12/1995 Walker et al. ..... 340/545.6
5,856,781 A * 1/1999 Michel et al. ..... 340/557
6,295,004 B1 9/2001 Burnett

* cited by examiner

*Primary Examiner*—Anh V La
(74) *Attorney, Agent, or Firm*—Charles J. Prescott

(57) ABSTRACT

A pre-injury contact warning device for a front door of an automatic dishwasher or oven, the front door being openable to a generally horizontal very low position above the floor. In one embodiment, the device includes a housing attachable to a surface of the front door. A warning signal emitter sensorially perceptible by a person receives electric power from a miniature storage battery mounted within the housing. An angle-sensitive switch mounted in the housing is operably interconnected between the warning signal emitter and the storage battery. The switch is open and the warning signal emitter off when the front door is closed, while the switch is closed and the warning emitter on when the front door is open. The warning signal emitter, when on, is sufficiently sensorially perceivable to warn or alert the person nearby the dishwasher that the front door is open and to be avoided. Other embodiments are provided which are operatively dependent upon other forms of sensory perception, e.g. sound and touch or feel. This invention may be incorporated at the time of appliance manufacture or as an aftermarket attachment.

9 Claims, 6 Drawing Sheets

APPLIANCE HAZARD WARNING DEVICE

BACKGROUND OF THE INVENTION

1. Scope of Invention

This invention relates generally to kitchen appliances having an openable front door, and more particularly to a sensorially perceivable hazard-waming device advising persons standing and working nearby the kitchen appliance that the front door is open and represents an injury inducing obstruction.

2. Prior Art

Kitchen appliances such as dishwashers and ovens have front doors which are openable by a pivotally downward and outward movement so that the open front door comes to rest in a generally horizontal orientation above the floor. The typical height of these open front doors is in the vicinity of the shin or lower leg of a typical adult person, e.g. in the range of 8" to 12" in height.

When these front doors are in the open position and being as low in relation to the floor as they typically are, a person working in the kitchen about the appliances either loading or unloading food from an oven or dishes from a dishwasher, can easily lose track or awareness of such open front doors. In these circumstances, the likelihood of running a lower leg or shin into or hitting one of the margins of the front door is greatly increased.

Applicant is a medical doctor specializing in dermatological care and routinely treats patients who have injured a shin or lower leg having inadvertently struck the open front door of a dishwasher or oven. More typically, dishwasher-related injuries are involved because the front door of a typical dishwasher is somewhat lower to the floor than the front door of a typical oven.

Applicant has taken an informal poll of approximately 1000 patients which have visited his office for their general skin care. Of those 1000 patients, over half have sustained leg trauma of which about 45% have incurred a leg injury causing skin damage or bruising and/or of sufficient severity to require professional medical attention. One such patient developed cutaneous cancer within two weeks of incurring such an injury which required surgery for removal of the cancerous tissue and an extended period of follow-up care and healing.

There appears to be no significant prior art which has, in any way, addressed this safety issue regarding open front doors of kitchen appliances such as dishwashers and ovens. An appliance door alarm apparatus invented by Thompson and disclosed in U.S. Pat. No. 4,894,643 teaches an audible or visual alarm which is actuated upon leaving the front door to the appliance open longer than a preselected time period. In U.S. Pat. No. 5,151,884, Griffith teaches a control system for an appliance indicator light for timing the amount of time the appliance front door is open after completion of the operational cycle of the appliance.

Prior to my U.S. Pat. No. 6,295,004, no patented or unpatented devices known to applicant addressed the issue of trying to avoid lower leg and shin injury caused by impact with the open front door of a kitchen appliance. The '004 patent teaches such a device both in aftermarket and original manufacture form, which gives persons standing and moving about the kitchen in the vicinity of an open door of an appliance a visual cue of the potential hazard of accidental impact with the open front door. The present invention greatly expands that inventive concept in utilizing the other human sensory attributes of hearing and touch or felt warning devices.

BRIEF SUMMARY OF THE INVENTION

This invention is directed to a pre-injury contact warning device for a front door of an automatic dishwasher or oven, the front door being openable to a generally horizontal very low position above the floor. In one embodiment, the device includes a housing attachable to a surface of the front door. A warning signal emitter sensorially perceptible by a person receives electric power from a miniature storage battery mounted within the housing. An angle-sensitive switch mounted in the housing is operably interconnected between the warning signal emitter and the storage battery. The switch is open and the warning signal emitter off when the front door is closed, while the switch is closed and the warning emitter on when the front door is open. The warning signal emitter, when on, is sufficiently sensorially perceivable to warn or alert the person nearby the dishwasher that the front door is open and to be avoided. Other embodiments are provided which are operatively dependent upon other forms of sensory perception, e.g. sound and touch or feel.

It is therefore an object of this invention to provide a visible hazard warning device which provides a sensorially perceivable pre-contact warning which advises persons on foot working in the vicinity of the appliance that the front door is open and that it represents an accident hazard to lower legs.

It is another object of this invention to provide a warning light device attachable to the openable front door of a kitchen appliance such as a dishwasher or oven which is activated upon opening of the front door to provide a sensorially perceivable cue to those working and moving about in the vicinity of the appliance that the front door is open and represents an injury hazard to shins and lower legs.

It is still another object of this invention to provide a perceivable cue to those working and moving about on foot in the vicinity of a kitchen appliance when the front door of the appliance is in an open position well below normal eye level of those persons which otherwise might be potentially injured by impact of the lower leg with a side or end margin of the open front door.

It is finally another object of this invention to provide a protective bumper along the door margins of appliances to reduce injury to the lower leg upon accidental contact.

It is yet another object to provide the above invention in either appliances with openable front doors at the time of manufacture or as an aftermarket device attachable to an appropriate surface of the existing appliance.

In accordance with these and other objects which will become apparent hereinafter, the instant invention will now be described with reference to the accompanying drawings.

DETAILED DESCRIPTION OF THE INVENTION

Figure 1:
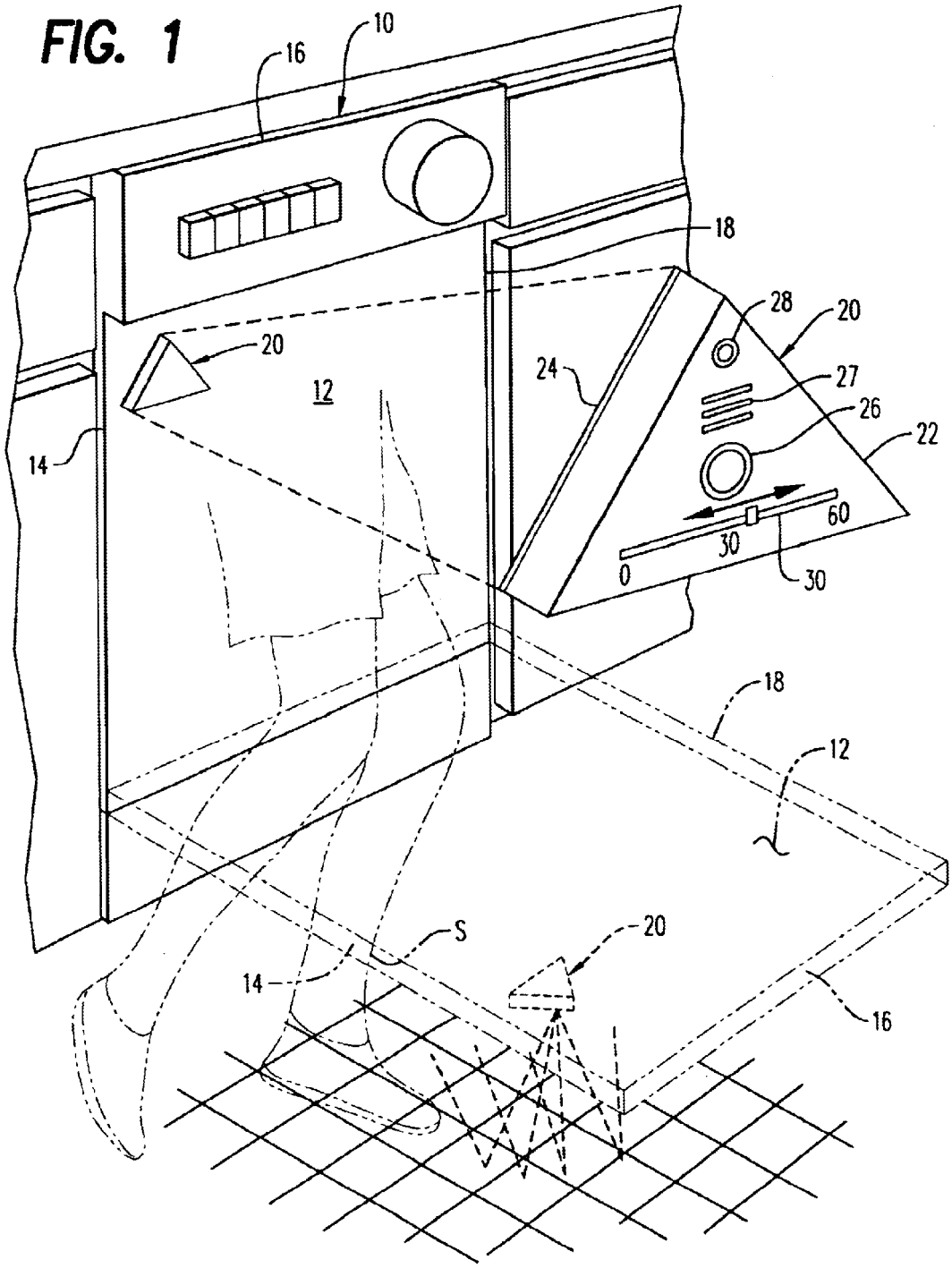
FIG. 1 is an exploded perspective view of one embodiment of the invention in the form of an add-on to a preexisting kitchen dishwasher.

Referring now to the drawings and firstly to FIG. 1, the preferred embodiment of the invention is there shown generally at numeral 20 in conjunction with a kitchen dishwasher shown generally at 10. The dishwasher 10 includes a front door 12 which is pivotally movable from the closed upright position shown in solid lines to the open horizontal position shown in phantom.

When the front door 12 is open as shown in phantom in FIG. 1, each of the side margins 14 and 18 and end or top margin 16 are positioned at a height above the floor equal to about the center of the shin or lower leg of an adult person shown in phantom working in the vicinity of the dishwasher 10. Accidental impact as e.g. at S between the shin of the person and one margin, e.g. 14 of the front door 12, is very likely to occur. These accidental injuries occur primarily because the front door 12 is very low to the normal field of vision of a person working in a kitchen and therefore random impact between the lower leg or shin and one of the margins of the front door 12 is very likely to occur.

Applicant, as a physician and surgeon, has examined, treated and taken medical histories for years of patients who had such common lower leg and shin skin wounds and injuries. The injury to the leg by accidental impact of the open front door of the dishwasher 10 or oven appliance, results in skin tears and abrasions which heal very slowly and frequently necessitate medical/surgical attention. Follow-up visits, prescriptions for infection and occasionally surgical treatment typically follow. Moreover, if the patient is older or diabetic, surgery and extensive follow-up treatment are also required.

In this embodiment 12 the invention, a warning light device 20 is attached as by double-sided adhesive tape to the distal corners of an outer surface of the front door 12. Each of these devices 20 include a "super strobe" LED 28 having a built-in circuit board and which is operably mounted in, and upwardly aimed from, a molded plastic housing 2 having an adhesive surface 24 on the back surface thereof. A loud audible horn or buzzer 27 is also operably connected to the circuit. Two 1.5-volt miniature batteries in series (not shown) are positioned within the housing 22 and are operably connected between the LED 28 and an angle-sensitive switch (not shown) which operably connects the storage battery (not shown) with the LED 28 and to the horn 27 when the device 20 is in the horizontal position shown in FIG. 1. When the front door 12 is in the closed upright position shown in solid lines in FIG. 1, the angle-sensitive switch interrupts electrical power to the LED 28 and to the horn 27. A mute switch 26 is provided to permanently interrupt power delivery to the horn 27. Power to the LED 28 and the horn 27 may be continuous or pulsed as regulated by a slide control 30.

As seen in FIG. 1, the LED 28 emits a strong, preferably pulsed stream of light downwardly in the direction of the arrows from a distal corner of the open front door 12 shown in phantom. In the form of a strobe or pulsating light beam and/or sound reflected upward from the floor, the person shown in phantom is much more aware of the fact that the front door 12 is open and the approximate position of the distal corners and associated side margins 14 and 18 and end or upper margin 16 so as to automatically avoid contact and injury between a lower leg and shin and the open front door 12.

Figure 2:
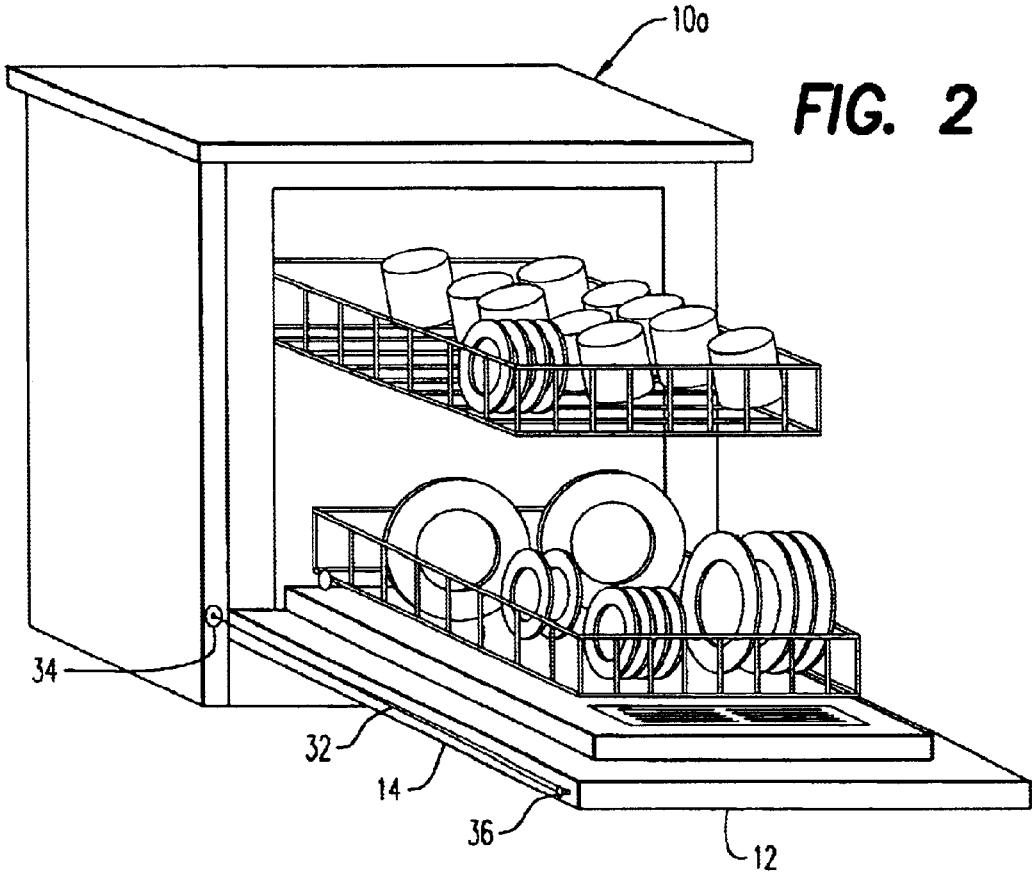
FIG. 2 is a perspective view of a front door of a dishwasher in its open position and incorporating another embodiment of the invention.
Figure 3:
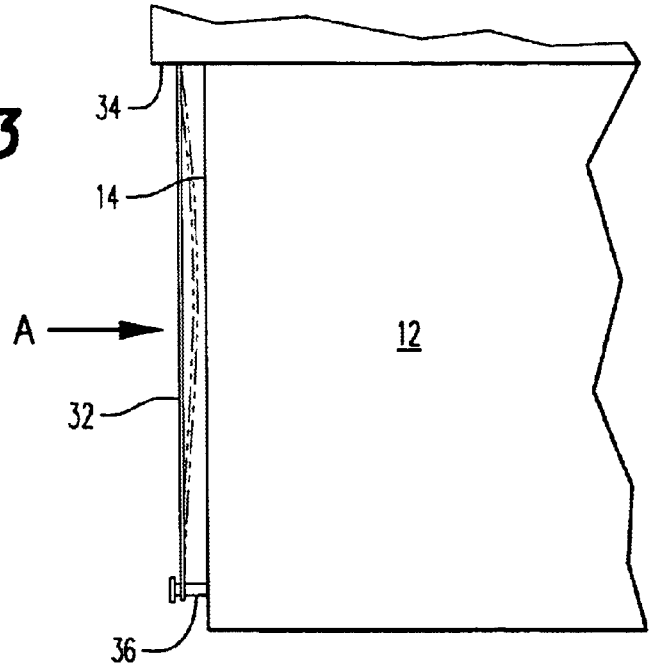
FIG. 3 is a top plan view of a portion of the open front door of FIG. 2.

Referring now to FIGS. 2 and 3, another embodiment of the invention is there shown at numeral 10*a* and includes a front door 12 shown in the open horizontal position. In this embodiment 10*a*, a tensioned string or flexible elastic or inelastic wire 32 extends along a substantial portion of at least one side margin 14. The inner end of the tensioned string 34 is attached to the housing of the dishwasher 10*a*, while the other end of the tensioned string 32 is attached to an offset post 36. By this arrangement, as best seen in FIG. 3, when a person comes in close proximity to the string 32 in the direction of arrow A, a short warning period is provided before shin contact is made with the side margin 14. When the front door 12 is moved to a closed position, the string 32 moves in unison therewith.

Figure 4:
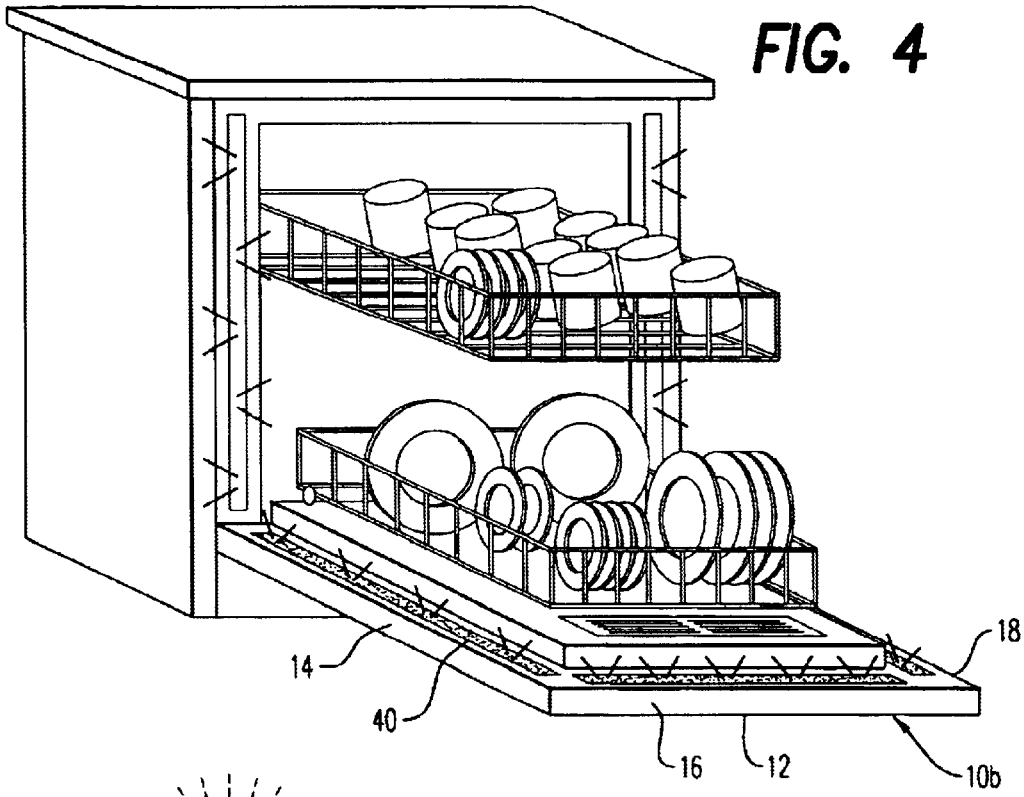
FIG. 4 is a perspective view of an open front door of a dishwasher and incorporating another embodiment of the invention.

Referring now to FIG. 4, yet another embodiment of the invention is there shown generally at 10*b* and includes a plurality of light reflective strips 40 which are adhesively attached and upwardly facing adjacent a substantial portion of each of the margins 14, 16 and 18 of front door 12. By this arrangement, overhead or elevated light from the kitchen itself will reflect upwardly to provide a viewable indicia by the person working around the open dishwasher 10*b* of the shin or leg hazard presented by the open door 12.

Figure 5:
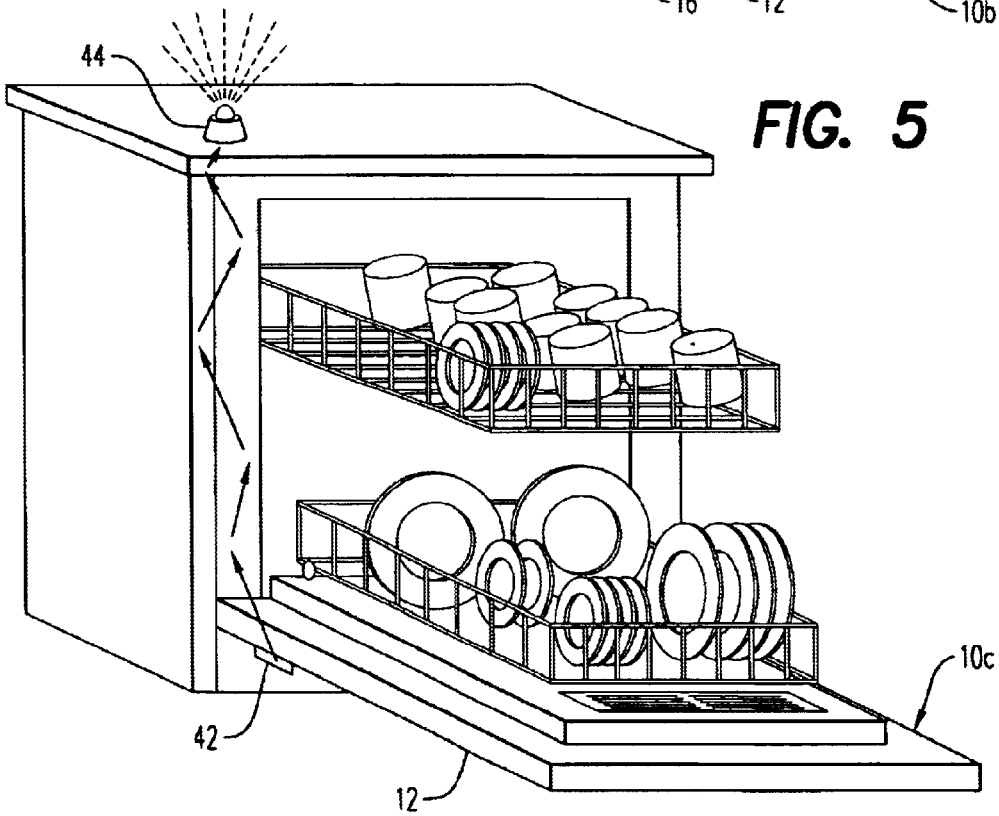
FIG. 5 is a view similar to FIG. 4 showing still another embodiment of the invention.

In FIG. 5, a remotely located strobe light 44 is positioned, for example, atop the counter above the dishwasher 10*c* or adjacent a cabinet closer to the wall as desired. A sending unit 42 which is also triggered to a "signal sending" status when the front door 12 is open, sends a radio signal to the strobe light 44 causing it to be activated and to thereby advise a person working in the vicinity of the open dishwasher 10*c* of the shin injury hazard associated with the open front door 12.

Figure 6:
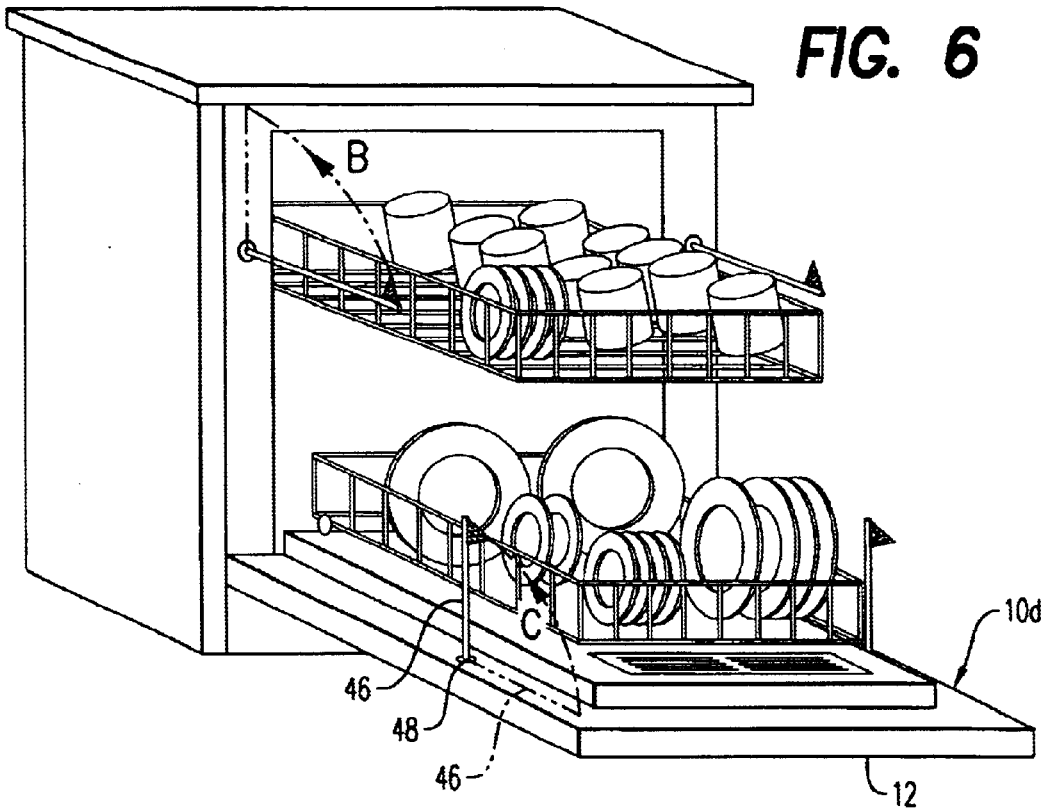
FIG. 6 is a view similar to FIG. 4 showing still another embodiment of the invention.

Still another embodiment of the invention is shown at 10*d* in FIG. 6. This embodiment 10*d* includes resilient flagstaffs or staffs 46 which are resiliently mounted at base 48 onto either the inner surface of the front door 12 along a side margin thereof and/or onto the side housing of the dishwasher 10*d* adjacent the door opening. When the open front door 12 is moved to a closed position, the staffs 46 resiliently deflect in the direction of the arrows B and C into the stored position shown in phantom. The resilient staffs 46 will automatically deploy into the position shown in solid upon opening the front door 12.

Figure 7:
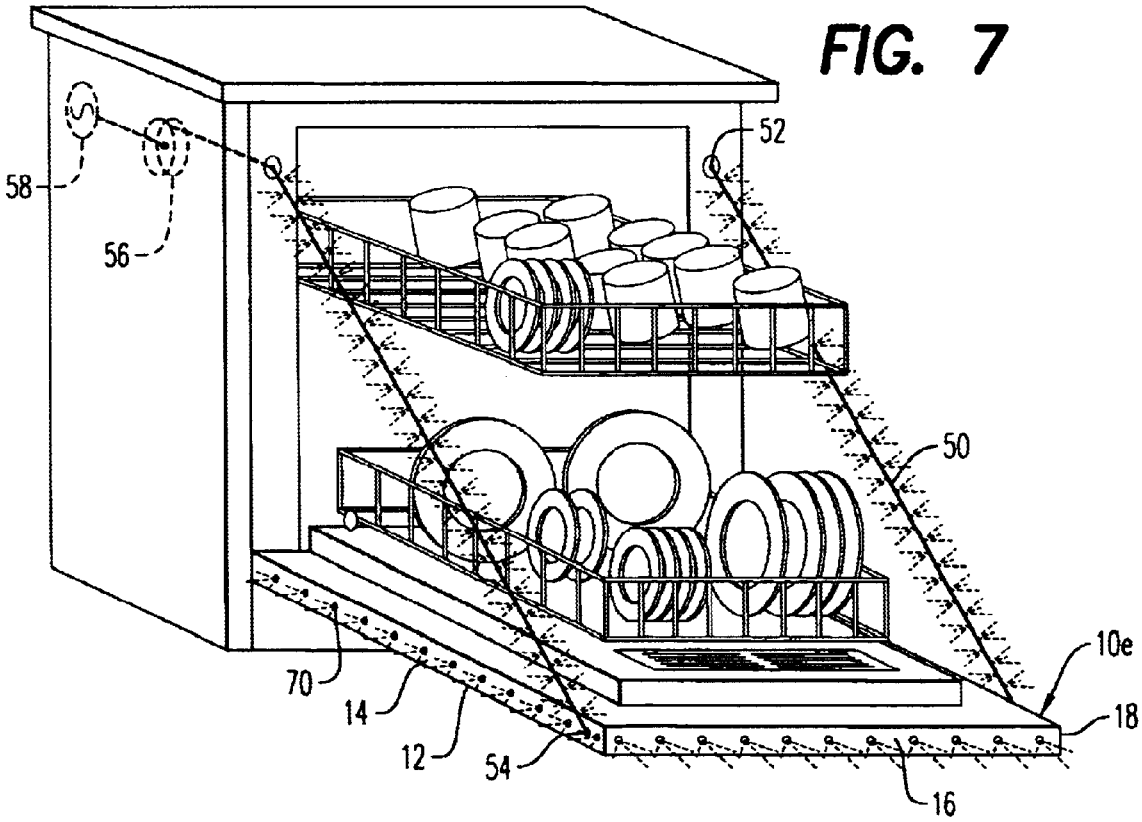
FIG. 7 is a view similar to FIG. 4 showing yet another embodiment of the invention.

A light sensory embodiment of the invention is shown generally at 10*e* in FIG. 7. In this embodiment 10*e*, two lengths of reflective rope or rope lights 50, when extended and activated, emit a warning light signal along substantially the entire length thereof to advise the person working in the vicinity of the opened dishwasher 10*e* of the hazard. Each of the rope lights 50 are retractable onto a reel 56 and are powered by a low-voltage d.c. power supply 58, both of which are shown in hidden lines within the housing of the dishwasher 10*e*.

In this embodiment 10*e*, an additional sensory warning adaptation in the form of touch or feel is additionally utilized by providing small streams of air which discharge from air apertures 70 and which are formed into the side margins 14, 16 and 18 of the front door 12. A separate air supply within the housing of the dishwasher 10*e* (not shown) is connected by flexible tubing to power the warning air stream distribution which emanates from these air nozzles 70.

Figure 8:
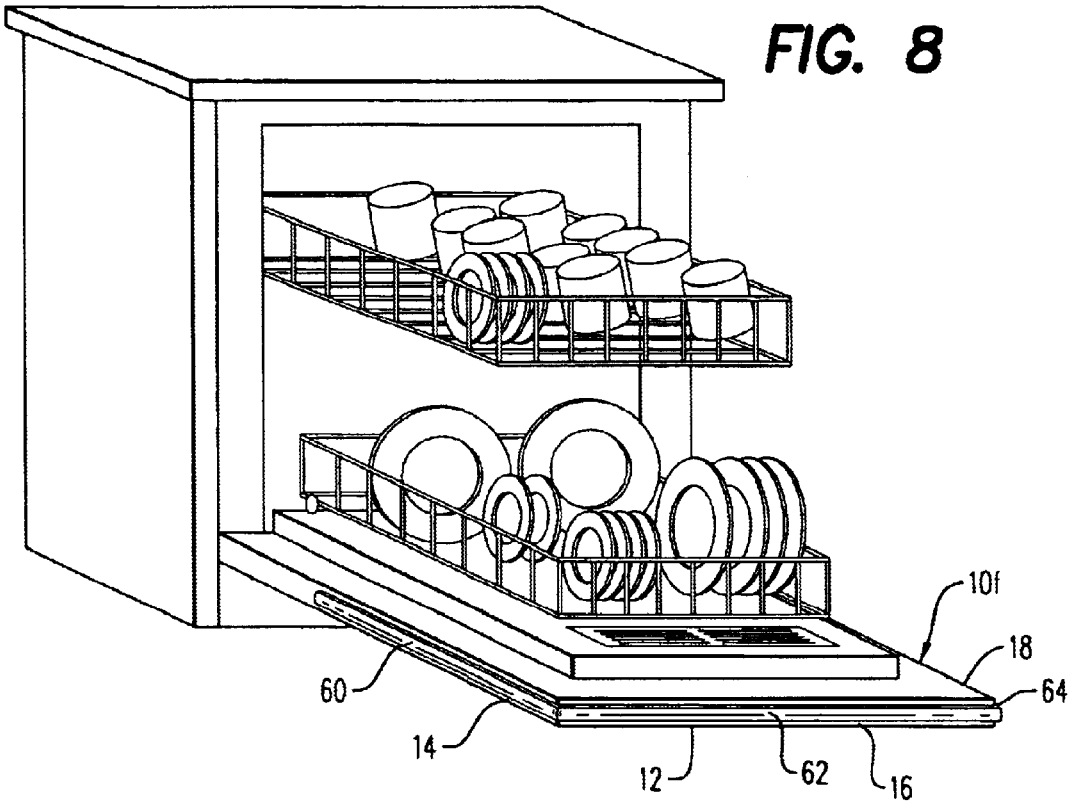
FIG. 8 is a view similar to FIG. 4 showing still another embodiment of the invention.
Figure 9:
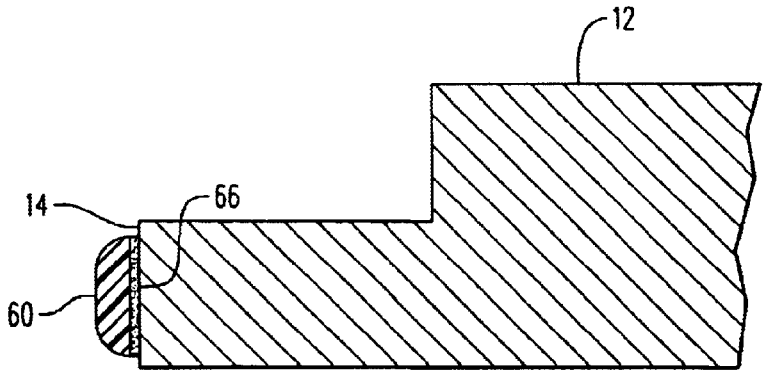
FIG. 9 is a section view of one margin of the open front door shown in FIG. 8.

Referring to FIGS. 8 and 9, yet another embodiment of the invention is there shown generally at 10*f* attached along the side end top margins 14, 18 and 16, respectively. Elongated strips of a viscoelastic polymer 60 are attached by adhesive layer 66 as best seen in FIG. 9. These viscoelastic polymer strips 60 provide both a felt warning or sensation of close proximity to the side or top margins of the door 12, but also provide an impact-absorbing feature which will tend to minimize any injury when this delicate shin area of the person strikes against and impacts these viscoelastic protective strips 60.

Figure 10:
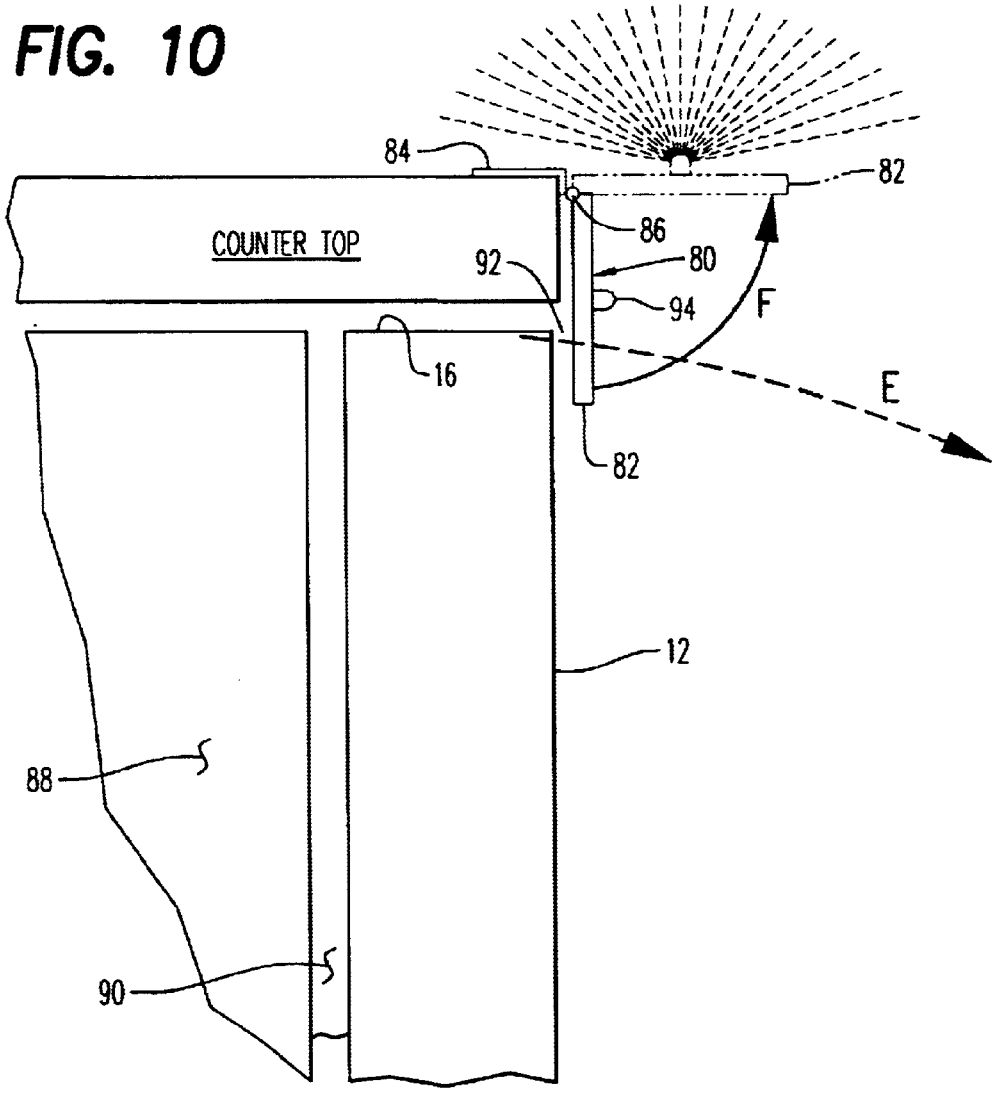
FIG. 10 is a side schematic view of the upper portion of the front door and countertop thereabove and including another embodiment of the invention.

Referring lastly to FIG. 10, still another embodiment of the invention is there shown generally at numeral 80 in the form of a device attachable to an upper surface along the outer margin of a countertop which is positioned above the top margin 16 of the door 12 of a dishwasher. This device 80 includes a housing 82 having a thin mounting plate 84 pivotally attached along pivotal axis or hinge 86 as shown. The housing 82 also includes a miniature battery (not shown) powering a strobe-type LED 94 and a position-sensitive switch (not shown) which makes an electrical connection between the battery and the LED 94 when the housing 82 is pivotally moved in the direction of arrow F from its closed position shown in solid lines in upright orientation into a generally horizontal orientation shown in phantom.

The positioning of the housing 82 from the closed position to the open position in the direction of arrow F is automatically accomplished as the front door 12 is opened in the direction of arrow E. Contact is made at 92 between the top surface 16 and the housing 82 to cause the pivotal motion of the housing 82 in the direction of arrow F.

To enhance the positive opening response of the housing 82, a well-known spring biased arrangement is included with the hinge connection 86. The hinge 86 is positioned slightly below the top surface of the countertop so as to minimize any possible interference caused thereby with other kitchen activity occurring atop the countertop such as cooking and the like. Again, this invention for appliances and door edges may be provided at the time of manufacture or in an after market device.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A pre-contact warning device attachable to a front door of an automatic dishwasher, the front door being openable to a generally horizontal position above a support surface of the dishwasher when loading and unloading dishes, said device comprising:

a housing attachable to a surface of the front door;

said housing including a pre-contact warning signal emitter and a miniature storage battery mounted within said housing;

an angle-sensitive switch mounted in said housing and operably interconnected between said warning signal emitter and said storage battery, said switch being open and said warning signal emitter off when the front door is closed, said switch being closed and said warning signal emitter on when the front door is open;

said warning signal emitter, when on, being sufficiently sensorially perceivable to warn or alert a person nearby the dishwasher that the front door is open and is to be avoided.

2. A pre-contact warning device as set forth in claim 1, wherein:

said signal emitter emits visible light;

said housing is structured for attachment to an outside surface of the front door whereby light is reflected upward from the support surface when the front door is open.

3. A pre-contact warning device as set forth in claim 2, wherein:

said signal emitter also emits an audible sound when the front door is open.

4. A pre-contact warning device as set forth in claim 3, wherein:

said signal emitter emits a pulsed and variable signal for enhanced warning discernment by the person.

5. A pre-contact warning device as set forth in claim 1, wherein:

said signal emitter produces sound.

6. An appliance warning device for a front door of an appliance, the front door being openable to a generally horizontal position above a support surface of the appliance, said device comprising:

a housing attached or attachable to a surface of or in close proximity to the front door;

said housing including a pre-contact warning signal emitter;

an angle-sensitive switch mounted in said housing whereby said switch is open and said warning signal emitter off when the front door is closed, said switch being closed and said warning signal emitter on when the front door is open;

said warning signal emitter, when on, being sufficiently sensorially perceivable to warn or alert a person nearby the appliance that the front door is open and is to be avoided.

7. The warning device as set forth in claim 6, wherein:

said signal emitter emits visible light;

said housing is structured for attachment to an outside surface of the front door whereby light is reflected upward from the support surface when the front door is open.

8. The warning device as set forth in claim 6, wherein:

said signal emitter emits visual light;

said housing includes a mounting plate pivotally and biasingly connected to said housing, said mounting plate adhesively attachable to a top counter surface in close proximity to a top margin of the front door;

said housing positioned for contact and pivotal movement from the open position to the closed position of said switch as the front door is opened whereby said signal emitter emits light each time the front door is opened.

9. The warning device as set forth in claim 6, wherein:

said signal emitter produces sound.

* * * * *